US007055776B2

(12) United States Patent
Hawighorst et al.

(10) Patent No.: US 7,055,776 B2
(45) Date of Patent: Jun. 6, 2006

(54) DEVICE FOR CONTINUOUS WINDING OF WEBS

(75) Inventors: Thomas Hawighorst, Osnabruck (DE); Rolf Kammann, Westerkappeln-Velpe (DE); Juergen Linkies, Lienen (DE)

(73) Assignee: Windmoeller and Hoelscher, Lengerich (DE)

( * ) Notice: Subject to any disclaimer, the term of this patent is extended or adjusted under 35 U.S.C. 154(b) by 0 days.

(21) Appl. No.: 10/490,051

(22) PCT Filed: Jun. 28, 2002

(86) PCT No.: PCT/EP02/07158

§ 371 (c)(1),
(2), (4) Date: Mar. 19, 2004

(87) PCT Pub. No.: WO03/035524

PCT Pub. Date: May 1, 2003

(65) Prior Publication Data

US 2004/0238679 A1 Dec. 2, 2004

(30) Foreign Application Priority Data

Oct. 24, 2001 (DE) ..... 101 52 495
Jan. 23, 2002 (DE) ..... 102 02 462

(51) Int. Cl.
*B65H 35/08* (2006.01)

(52) U.S. Cl. ..... 242/527; 242/527.2; 242/541.4

(58) Field of Classification Search ..... 242/532, 242/532.1, 527, 527.2, 541.4–541.7
See application file for complete search history.

(56) References Cited

U.S. PATENT DOCUMENTS

| | | | | |
|---|---|---|---|---|
| 4,488,687 | A | 12/1984 | Andreasson | |
| 4,678,133 | A | 7/1987 | Suzuki | |
| 5,273,222 | A * | 12/1993 | Hutzenlaub et al. | 242/527 |
| 5,823,461 | A * | 10/1998 | Hartley et al. | 242/532.3 |
| 5,845,867 | A * | 12/1998 | Hould et al. | 242/527 |
| 6,308,908 | B1 * | 10/2001 | Marchante | 242/527.3 |

FOREIGN PATENT DOCUMENTS

| | | |
|---|---|---|
| DE | 33 18 803 A1 | 5/1983 |
| DE | 37 408 836 C1 | 12/1987 |
| DE | 88 15 296.0 | 12/1988 |
| EP | 0 183 135 A1 | 11/1985 |
| EP | 0 183 135 T1 | 11/1985 |

* cited by examiner

*Primary Examiner*—Kathy Matecki
*Assistant Examiner*—Sang Kim
(74) *Attorney, Agent, or Firm*—Jacobson Holman PLLC

(57) ABSTRACT

A device for continuous winding of webs on winding shafts onto winding rollers consisting of arms supporting the winding shaft, a pressure roller that can be engaged on the winding shaft or winding core, a knife separating the web during the roller change, and of a charging electrode supplying the web start with an electrostatic charge, which attaches the web start, newly formed by the web cut, on the winding shaft. In order to always maintain the correct equal distance to the web supplied with the charge, the same is tracked in such a manner that the distance of the charging electrode to the web remains constant regardless of the diameter of the winding shaft.

15 Claims, 7 Drawing Sheets

DEVICE FOR CONTINUOUS WINDING OF WEBS

This is a nationalization of PCT/EP02/07158 filed Jun. 28, 2002 and published in German.

BACKGROUND OF THE INVENTION

1. Field of the Invention

The invention relates to a device for continuous winding of webs, preferably webs made of thermoplastic synthetic material, onto winding shafts or winding cores to winding rollers, with arms supporting the winding shaft that is preferably equipped with a drive, with a pressure roller that can be engaged on the winding shaft or winding core, with a knife separating the web during a roller change, and with a device for start winding of the new web start onto the winding shaft or winding core that is formed by the web cut.

2. Description of the Related Art

A particular problem in devices of this type is start-winding the new web start formed by the web cut during the roller change onto a new winding shaft or winding core. It is known to apply an adhesive coating onto the winding shaft or winding core, to which the web start adheres on the winding shaft or winding core, accelerated to web speed, for start winding the web start of the web fed at a constant speed. However, manageability of winding shafts or winding cores equipped with adhesive coatings is extensive and complicated. Furthermore, placining web starts around the winding core or winding shaft by means of ring-shaped vacuum channels, or special ring-shaped guide channels with insert wedges, until the second enlacement attaches the web start onto the winding core is known. Such devices are also relatively complicated and extensive.

SUMMARY OF THE INVENTION

The aim of the invention to create a device of the previously stated type, which independent from the respective diameter of the winding shaft or of the winding core enable simple winding of web starts formed by web cuts during the roller change onto winding shafts or winding cores.

This task is solved according to the present invention by a device for continuous winding of webs, preferably webs made of thermoplastic synthetic material, onto winding shafts or winding cores to winding rollers. The device includes a pressure roller that can be engaged on the winding shaft or winding core, with a knife separating the web during a roller change, and with a device to start winding of a new web start, as formed by the web cut, onto the winding shaft or winding core. The start winding device includes a charging electrode that is equipped with at least one electrostatic charge and, with the knife, is arranged in machine direction of the web behind the winding shaft or winding core. The start winding device is connected to the pressure roller which is movable by means of a gear in such a manner that the distance between the charging electrode and the web remains substantially constant regardless of the diameter of the winding shaft or winding core.

According to a preferred embodiment it is provided that the device, for winding consists of a charging electrode equipped with an electrostatic charge located at the web start, which is arranged at a predetermined distance to the web and coupled to the traveling pressure coil via of gear means, in such a manner that their distance to the web remains constant regardless of the diameter of the winding shaft or winding core.

It is known from U.S. Pat. No. 4,852,820 to get the web start formed by a web cut of a continuously fed film web in adhesive contact with a winding coil or winding core in such a manner that the web start is equipped with an electrode with an electrostatic charge, which actuates this adhesion. However, the necessary electrostatic charge can only be applied to the web start formed by the web cut in an optimum manner before the web cut is performed, if the charging electrode has the correct predetermined distance to the web. Webs and preferably film webs of different diameters are usually wound onto winding rollers or winding cores of winding devices so that maintaining the correct predetermined distance of the charging electrode to the web can present a problem. In the device according to the invention, the charging electrode always adjusts to the correct predetermined distance to the web, in that it is tracked by means of tracking devices in such a manner that the distance to the web remains constant regardless of the diameter of the winding shaft or winding core.

A preferred embodiment provides that the pressure roller is supported in a carriage traveling in a frame, and the charging electrode expanding across the width of the web is held between the arms of two-armed levers, which are pivot-supported on lateral components or the carriage, and that the other arms of the two-armed levers carry link blocks or rollers that are designed according to the required tracking movement of the charging electrode.

Purposefully, the carriage can travel on or parallel to a surface, which is spanned by means of the axes of the winding shaft and of the pressure roller.

The carriage can travel in the frame by means of a gear motor, the pinion gear of which combs with a gear rod of the carriage. Controlling the gear motor can be achieved by means of a computer.

Purposefully, the knife is held at the carrier that carries the charging electrode. According to a simple embodiment it is provided that the knife is moveable from a pneumatic cylinder without a piston rod at a right angle to the web.

In order to enable winding from left to right, a second tracking charging electrode with a knife is arranged laterally reversed from the plane, which is spanned by means of the axes of the winding shaft and the pressure roller in a preferred embodiment.

BRIEF DESCRIPTION OF THE DRAWINGS

One embodiment example of the invention is explained in further detail below based on the drawing. It shows.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
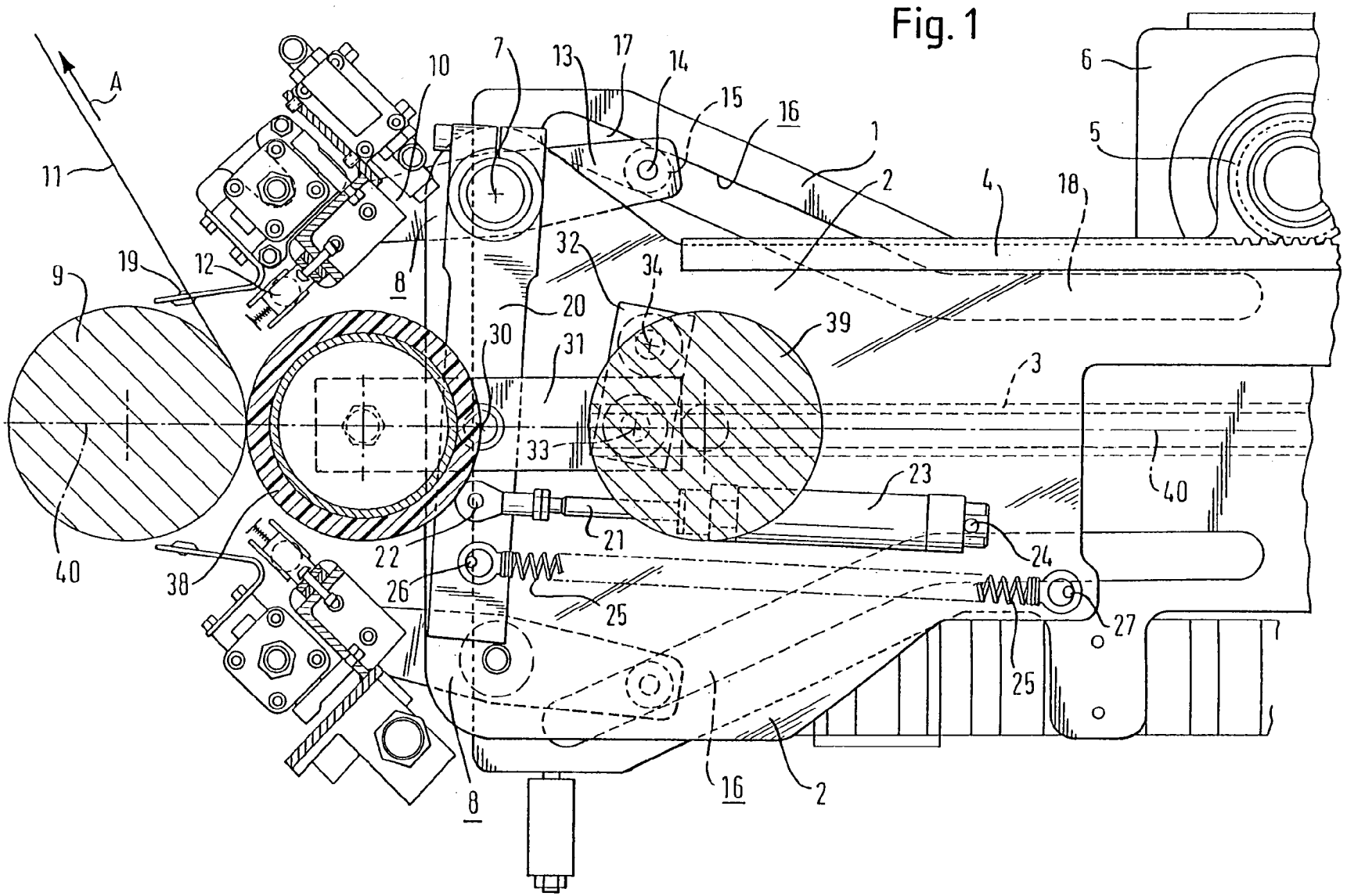
FIG. 1 a side view of the winding device according to the invention with a distant front side wall of the frame, FIG. 2 the device drawn from FIG. 1 for adjusting a constant distance of the charging electrode, which is independent of the diameter of the winding shaft, to the newly to be wound web start at the time of cutting the web during a roller change, FIGS. 3–6 the different positions of the charging electrode to the winding cores of different diameters according to FIG. 2, and FIG. 7 a top view of the device according to FIGS. 2 to 6.

FIG. 1 shows a rear plate-shaped side component 1, which is part of a frame. The front side component is removed in order to better view the devices arranged between the side components.

A carriage is guided horizontally movable between the side components 1. Only the side wall 2 is illustrated of the carriage, as the front side wall is again removed for reasons of better illustration. The side walls 2 of the carriage are connected to each other by traverse members not illustrated. The side walls 2 are guided in a movable manner in guides 3 of the side components 1 that are illustrated in broken lines. At its upper side edge, the side wall 2 at the minimum is equipped with a gear rod 4 having teeth that mesh with the pinion gear 5 of a gear motor 6, which is controlled by the electronic machine control for moving the carriage with the side walls 2.

On both sides of a shaft 7 that is supported between the side walls 2, two-armed levers 8 are pivot-supported, the arms 10 of which point in the direction of the winding core 9, which carry the charging electrode 12 that expands across the width of the web 11. The interior arms 13 of the two-armed lever 8 are equipped with axle journals 14, on which rollers 15 are supported, which are guided in guides 16 of the side components 1 of the frame, and which consist of slotted holes. The guides 16 consist of a laterally extending section 17 and connected to the same, of a section 18 extending parallel to the guide 3.

Not only is the electrode 12 attached to the arms 10 of the two-armed lever 8 extending toward the exterior, but additionally also a linear unit, such as a piston rod-less pneumatic cylinder, which moves a knife 19 across the width of the web 11 for the purpose of cutting the web 11.

On both sides of the shaft 7 rockers 20 are pivot-supported on the interior sides of the carriage side walls 2, which are pivoted by means of the pneumatic cylinder 23, the piston rods 21 of which are pivot-supported on journals 22 of the rockers 20. The cylinders 23 are pivot-supported on journals 24 of the carriage side walls 2.

Tension springs 25 are arranged below the pneumatic cylinders 23 parallel to the same, the ends of which are suspended from journals 26 of the rocker 20, and journals 27 of the side wall 2.

The rockers 20 carry axle journals 30 above the pneumatic cylinders 23, on which coupling elements 31 are supported. At their rear ends, the coupling elements 31 are pivot-connected to guides 32 in the joint points 33, the upper ends of which are pivot-supported on axle journals 34 of the side walls 2. The coupling elements 31 transfer the rockers 20 in the direction of the winding core 9. The pressure roller 38 is supported between the free ends of the piston rods 31.

The electrode 12 may consist of a number of needles, and is laterally encased by rails, which provide protective cover.

The arrangement of the knife 19 with the cylinder on the carrier of the electrodes 12 results in a cut closely above the roller gap between the winding core 9 and the pressure roller 38 once the knife is activated so that a web start with a short flap is created.

The web 11 moves in the direction of arrow A, and is fed to the pressure roller 38 by a guide roller 39, which may be supported, for example, between the-side walls 2 of the carriage.

The two-armed levers 8 with electrodes 12 and knives 19, as well as the guides 16 for the rollers 15 of the interior arms of the two-armed levers 8, are arranged laterally reversed to a midplane 40, which extends through the axes of the winding core 9 and the pressure roller 38. In this way, a simple conversion of the winding device to wind from left to right is possible.

In order to further explain the invention, it is again described based on FIGS. 4 to 7, which show the individual components and assembly groups drawn from FIG. 1.

Figure 2:
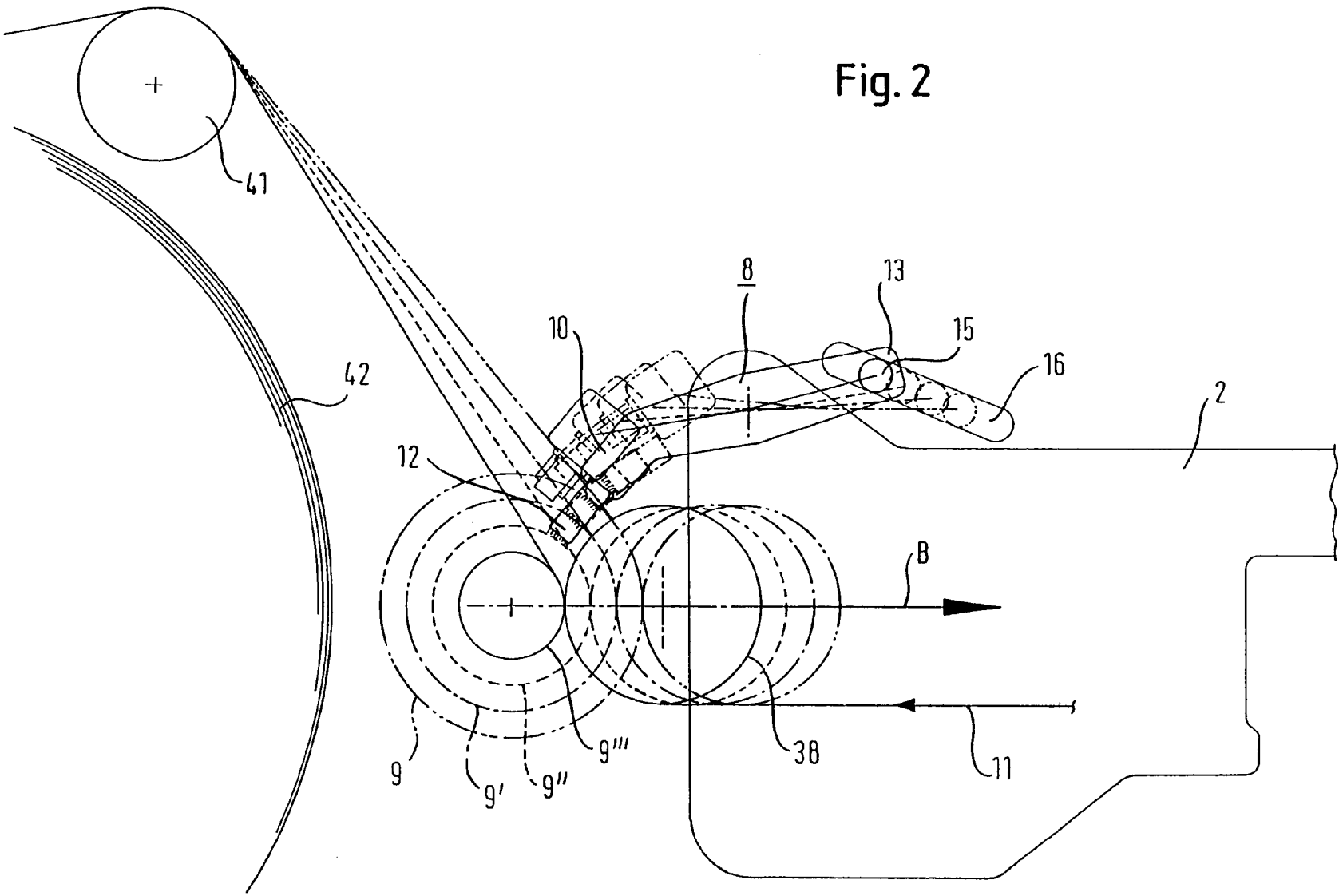
Figure 3:
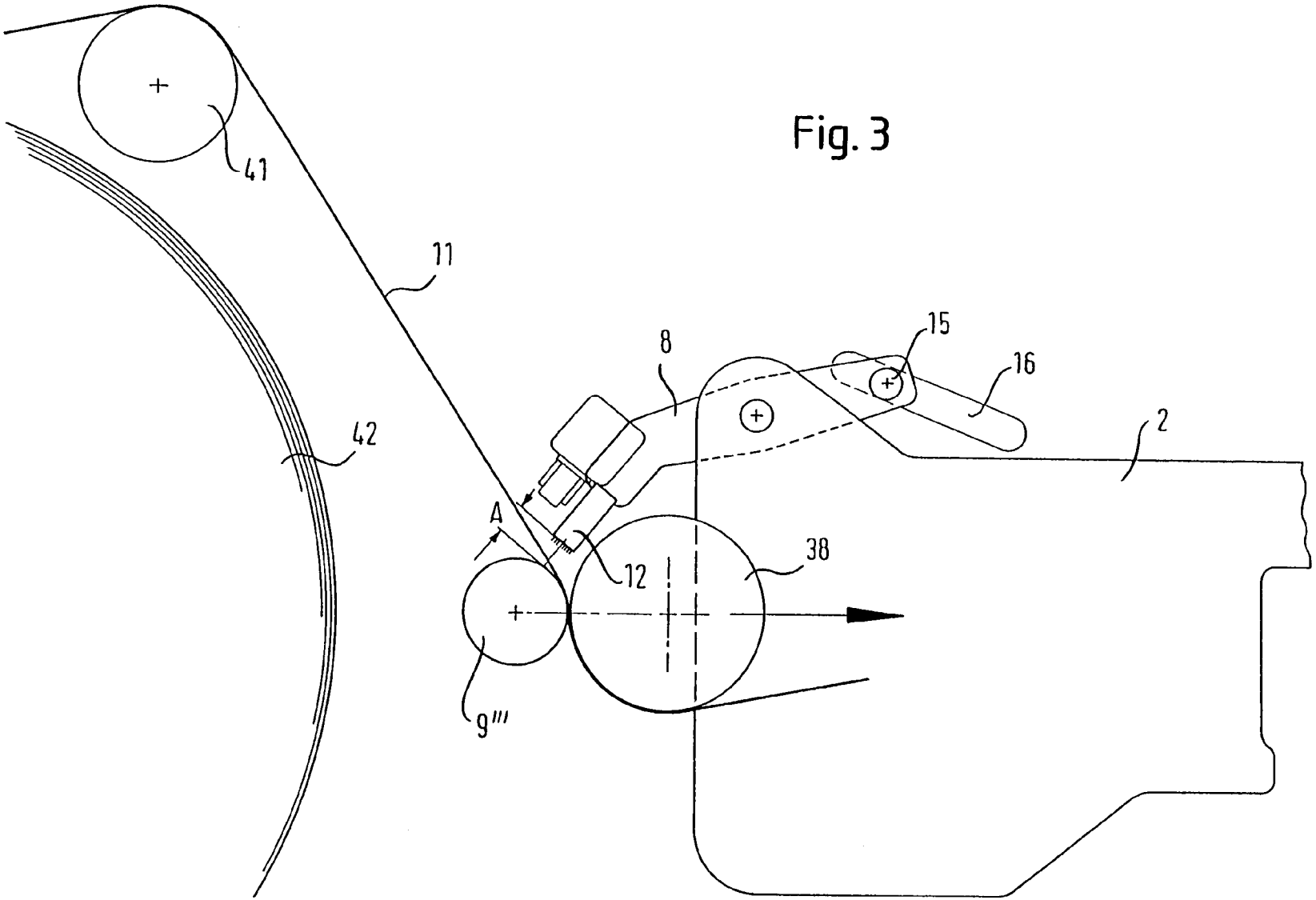
Figure 4:
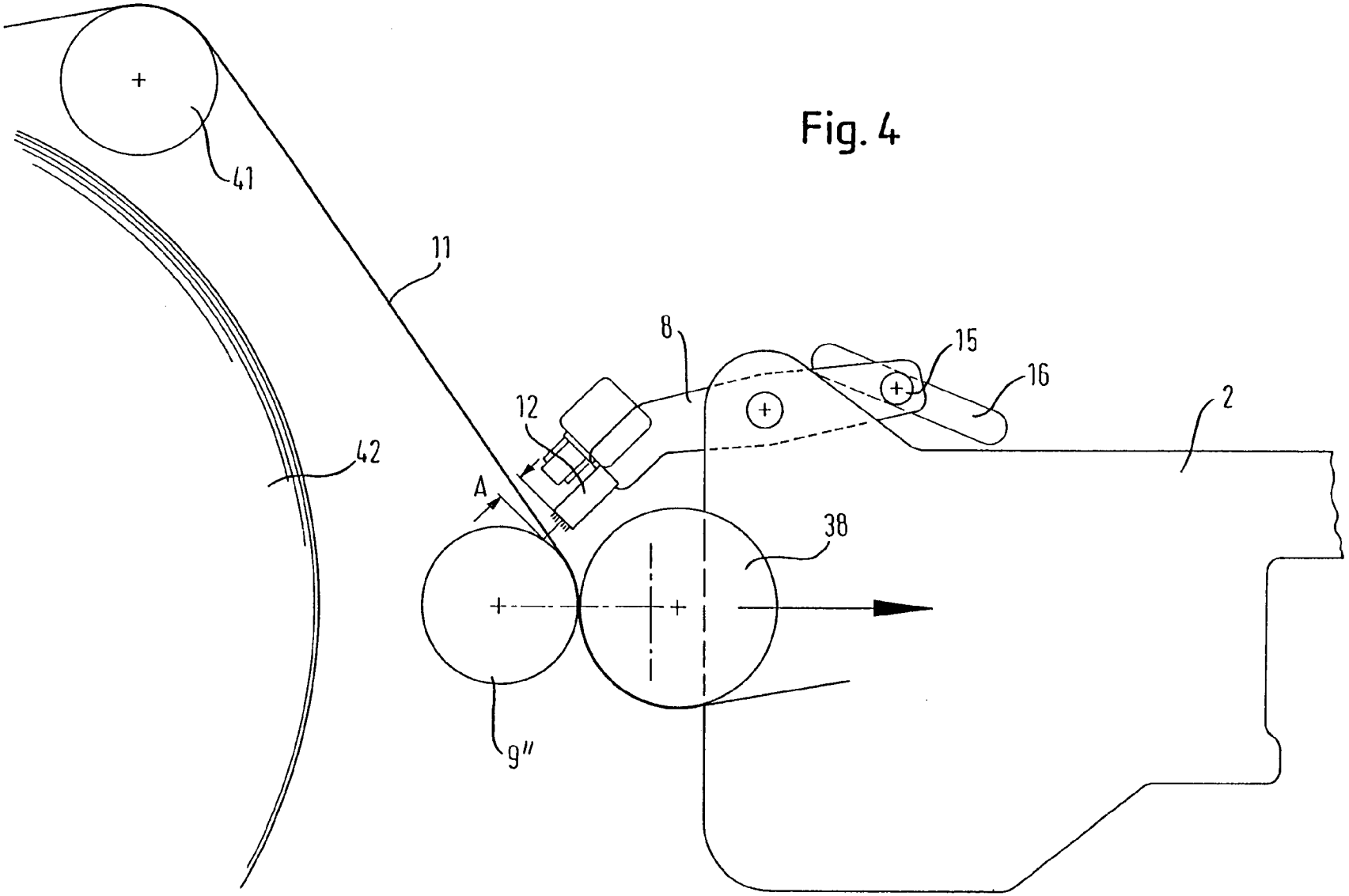
Figure 5:
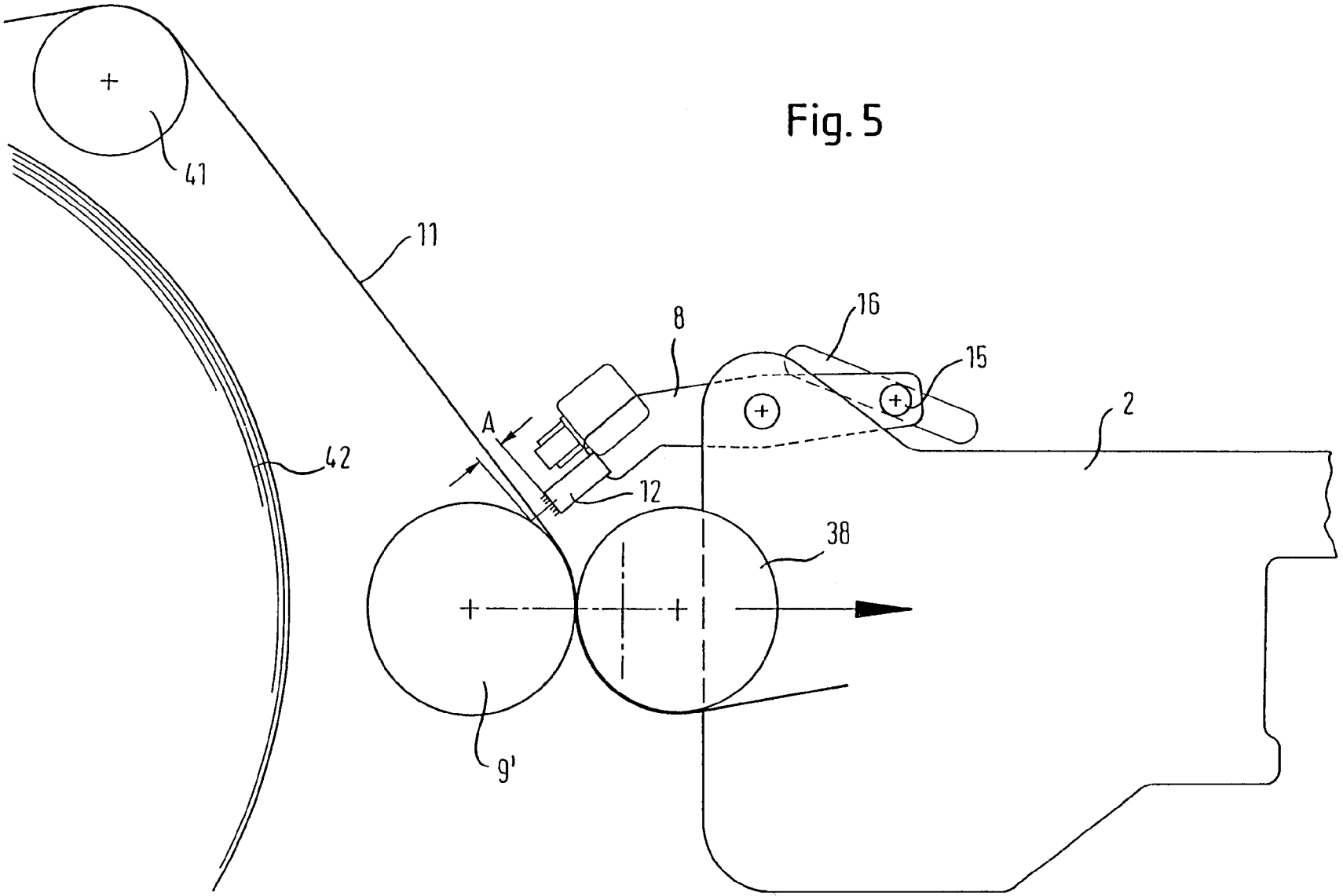
Figure 6:
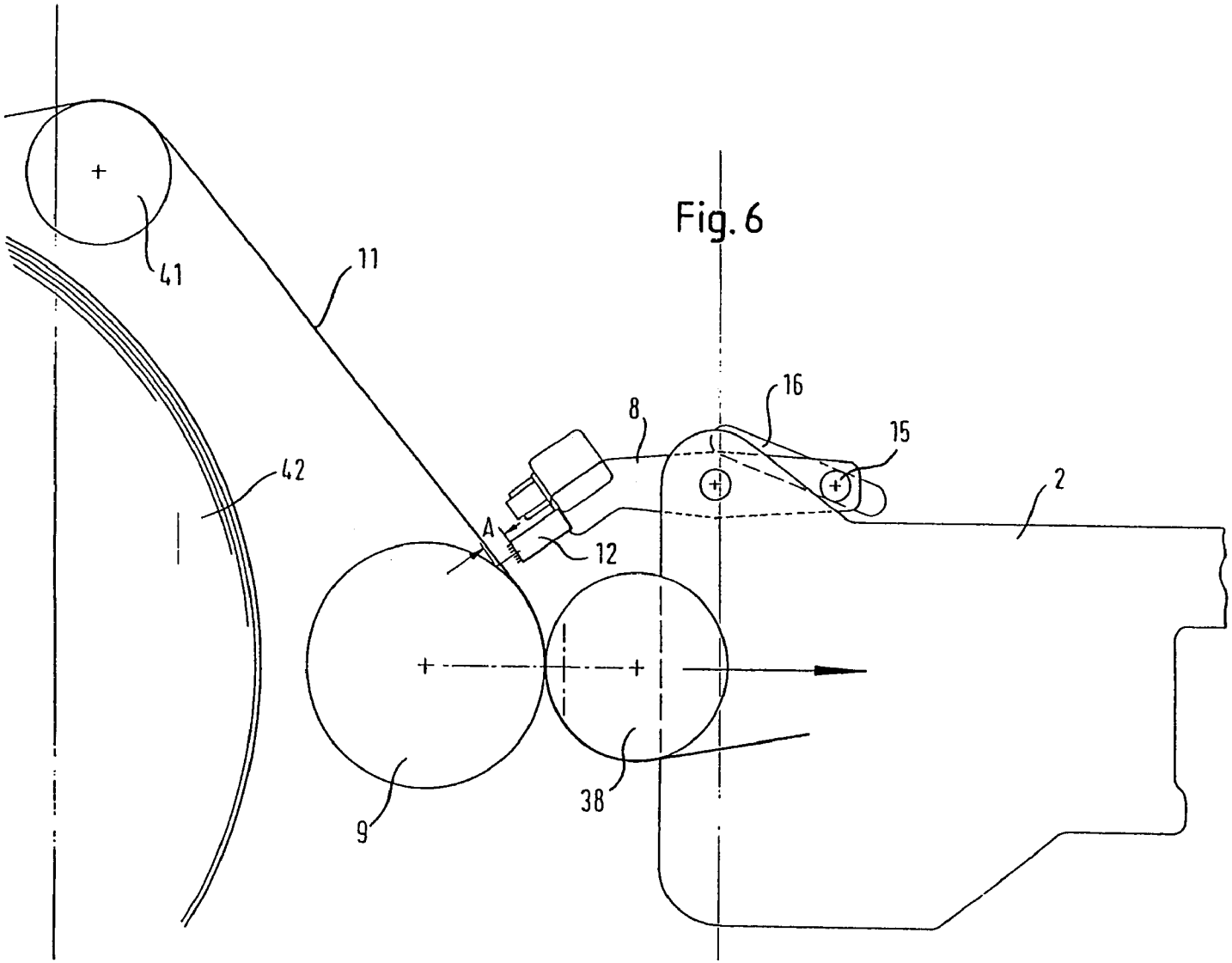

As FIG. 2 shows, the winding cores or winding shafts 9, 9', 9", 9'" of different diameters can be inserted into the winding device. At each winding core or winding shaft, the same is pressed against the respectively inserted winding core by the movement of the carriage 2, and pressing on the pressure roller 38 by means of the pneumatic cylinder 23. By means of a respective movement of the carriage 2 in the direction of arrow B, the two-armed lever 8 is pivoted by means of a corresponding movement of the rollers 15 in the inclined slotted holes 16 in such a way that the electrodes 12 always have the same distance to the web 11 winding off of the winding cores regardless of the diameter of the winding cores 9, 9', 9", 9'".

As FIG. 2 shows, the web 11 runs across a guide roller 41 to the winding roller 42, which is almost completely wound between the other arms of the turret winder.

FIGS. 3 to 6 show the individual winding shafts or winding cores 9, 9', 9", 9'", on which the pressure roller 38 is engaged. Due to the characteristics of the incline of the guideway 16 and the design of the two-armed lever 8 it is ensured that the electrode 12 always adjusts itself to the correct distance A to the web 11 winding off of the winding shaft or winding core by means of the corresponding movement of the carriage 2.

Figure 7:
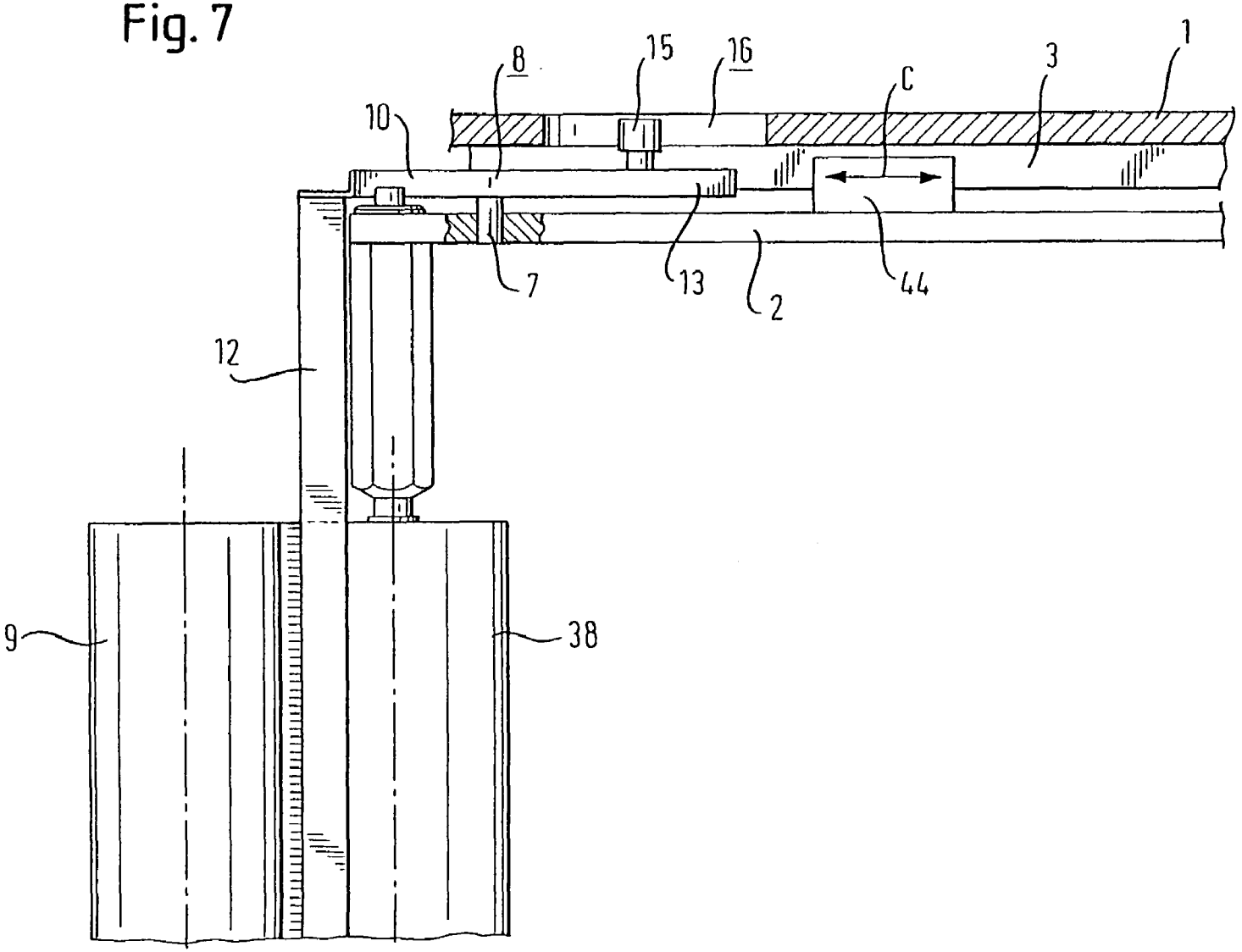

FIG. 7 shows a top view of components of the winding device, partially in a section. The side wall 1 of the frame is equipped with a slotted hole 16 forming a guide, in which the bottom roller 15 is guided, which is supported on the lever arm 13 of the two,-armed lever 8 that is directed toward the interior. The two-armed lever 8 is supported by an axle journal 7 at the side wall 2 of the carriage, which is guided across guide pieces 44 in the direction of the double arrow C on guides 3 of the frame. The arm 10 of the two-armed lever 8 pointing in the direction of the winding core 9 carries the electrode 12, which supplies an electrostatic charge to the web 11 winding off of the winding core 9 during the roller change before the web cut is performed. This charge occurs in the known manner, whereby the winding shaft may have the counter potential as opposed to the charging electrode 12.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

The invention claimed is:

1. A device for continuous winding of webs onto winding shafts or winding cores to winding rollers, comprising:

a winding shaft or a winding core;

a pressure roller that can be engaged on the winding shaft or winding core, said pressure roller being movable by a drive mechanism;

a cutting element for severing the web during a winding roller change to form a new web start portion; and a start winding device to start winding of the new web start portion onto the winding shaft or winding core, said start winding device including a charging electrode that is equipped with at least one electrostatic charge;

said cutting element and said start winding device being arranged, in a traveling direction of the web, behind a point at which the pressure roller touches the winding shaft or winding core when engaged therewith;

said start winding device being connected to said pressure roller so that said start winding device moves when said pressure roller is moved by said drive mechanism, with a distance between the charging electrode and the web thus being related to the movement of said pressure roller such that said distance remains substantially constant regardless of a diameter of the winding shaft or winding core; and said pressure roller being supported in a carriage that is movable within a frame, said charging electrode being held between first arms of two-armed levers which are pivotally arranged on side walls of the carriage, second arms of said two-armed levers carrying link components which run along guides on the frame which are designed according to required movements of the charging electrode to maintain said distance.

2. The device according to claim 1, wherein the carriage is moveable in or parallel to a plane which is spanned by axes of the winding shaft or winding core and of the pressure roller.

3. The device according to claim 2, further comprising a second tracking charging electrode with a cutting element arranged laterally reversed from the plane which is spanned by axes of the winding shaft or winding core and of the pressure roller.

4. The device according to claim 1, wherein said link components are rollers.

5. The device according to claim 1, wherein said pressure roller is supported in a carriage movable within a frame, said drive mechanism including a motor mounted to the frame and having a pinion gear that meshes with teeth on a gear rod of said carriage.

6. The device according to claim 1, wherein the carriage is moveable in the frame by means of a gear motor having a pinion gear that meshes with teeth on a gear rod of the carriage.

7. The device according to claim 1, wherein the cutting element is held at a carrier that carries the charging electrode.

8. The device according to claim 1, wherein the cutting element is moveable at a right angle to the web by means of a pneumatic cylinder without a piston rod.

9. A device for continuous winding of webs onto winding shafts or winding cores to winding rollers, comprising:

a winding shaft or a winding core;

a pressure roller that can be engaged on the winding shaft or winding core, said pressure roller supported in a carriage that is movable between side components of a frame by a drive mechanism;

a cutting element for severing the web during a winding roller change to form a new web start portion; and a start winding device connected to said pressure roller for starting winding of the new web start portion onto the winding shaft or winding core, said start winding device including a charging electrode that is equipped with at least one electrostatic charge, said charging electrode spanning a width of said web and being held between first arms of two-armed levers which are pivotally arranged on side walls of said carriage, second arms of said two-armed levers carrying linking components which run along guides of said frame side components that are designed according to required tracking movements of the charging electrode such that movement of said pressure roller by said drive mechanism causes said start winding device to move in said guides so that a distance between the charging electrode and the web remains constant regardless of a diameter of the winding shaft or winding core.

10. The device according to claim 9, wherein said cutting element and said start winding device are arranged, in a traveling direction of the web, behind a point at which the pressure roller touches the winding shaft or winding core when engaged therewith.

11. The device according to claim 9, wherein the drive mechanism for moving said carriage includes a gear motor having a pinion gear that meshes with teeth on a gear rod of the carriage.

12. The device according to claim 11, wherein said linking components are rollers.

13. A device for continuous winding of webs onto winding shafts or winding cores to winding rollers, comprising:

a winding shaft or a winding core;

a pressure roller that can be engaged on the winding shaft or winding core, said pressure roller being supported by a carriage movable between side components of a frame by a drive mechanism;

a cutting element for severing the web during a winding roller change to form a new web start portion; and a start winding device to start winding of the new web start portion onto the winding shaft or winding core, said start winding device including a charging electrode that is equipped with at least one electrostatic charge;

said start winding device being pivotally connected to said pressure roller carriage via a lever arm so as to be movable with said pressure roller, said lever arm also being operatively coupled with a guide in said frame having an angled portion relative to movement of said carriage that changes a pivot angle of said start winding device when said pressure roller carriage is moved relative to said frame and with said lever arm in said guide angled portion, said guide adjusting said pivot angle to provide corresponding movement of the charging electrode such that a distance between the charging electrode and the web remains substantially constant regardless of a diameter of the winding shaft or winding core.

14. The device according to claim 13, wherein said guide further includes a portion that extends parallel with said carriage movement.

15. The device according to claim 13, wherein said guide includes slotted holes in said frame with said lever arm having link blocks or rollers that run in said slotted holes.

* * * * *